US005579812A

United States Patent [19]

Bigwood

[11] Patent Number: 5,579,812

[45] Date of Patent: Dec. 3, 1996

[54] PET FECES DISPOSAL APPARATUS

[76] Inventor: Adam A. Bigwood, 928 N. San Vicente - Suite 2, West Hollywood, Calif. 90069

[21] Appl. No.: 520,234

[22] Filed: Aug. 28, 1995

[51] Int. Cl.[6] ..... B65B 1/04; B65B 3/04; B67C 3/02

[52] U.S. Cl. ..... 141/109; 141/108; 141/111; 141/114; 141/313; 141/314; 15/257.1; 294/1.3; 294/55

[58] Field of Search ..... 141/10, 108–114, 141/313, 314, 316, 358, 311 A, 388–392, 86–88; 15/257.1; 294/1.3–1.5, 55

[56] References Cited

U.S. PATENT DOCUMENTS 4,251,097 2/1981 Whitten II ..... 294/55
4,741,565 5/1988 Bagg ..... 294/1.3
4,865,371 9/1989 Egberg ..... 294/1.3
5,222,777 6/1993 Clonch ..... 294/1.3

*Primary Examiner*—Henry J. Recla
*Assistant Examiner*—Timothy L. Maust
*Attorney, Agent, or Firm*—Hovey, Williams, Timmons & Collins

[57] ABSTRACT

A lightweight, portable and disposable pet feces disposal apparatus is disclosed. The apparatus includes a full size scoop and an attached disposal bag that both collapse and fold to a size that can be easily carried in a person's pocket or purse.

5 Claims, 3 Drawing Sheets

46
12
10
10
12
48
46
30
28
24

12
16
40
14
18
22
32
36
34
30
38
20
10

10
12
22
16
24
42
40
18
36
44
32
42
20
38
44
43
14
43

PET FECES DISPOSAL APPARATUS

BACKGROUND OF THE INVENTION

1. Field of the Invention

The present invention relates to devices for collecting and disposing pet feces. More particularly, the invention relates to a portable pet feces disposal apparatus including a full size scoop and an attached disposal bag that both collapse and fold to a size that can be easily carried in a person's pocket or purse before use.

2. Description of the Prior Art

Many cities have ordinances requiring pet owners to collect and dispose pet feces left by their pets in public areas such as parks, sidewalks and streets. Thus, it is often necessary for pet owners to carry feces collection and disposal devices with them while walking their pets.

Pet feces disposal devices are known in the art; however, these prior art devices are generally ill-suited for use by active pet owners and for use in areas remote from trash cans. For example, prior art disposal devices are typically heavy and bulky because they are formed with large metal scoops and long metal or wooden handles. Thus, these devices are difficult to carry while on long walks with a pet. Moreover, these types of prior art disposal devices require large areas for storage between use.

Another limitation of prior art pet feces disposal devices is that they lack structure for enclosing and sealing the feces after it is collected. With prior art collection devices, feces that is scooped up is left exposed in the scoop until carried to a trash can for disposal. This is a problem if feces must be collected in areas where few trash cans exist, and is a particular problem if the disposal device must be placed in a car after use for transporting the feces to the pet owner's home or to a trash can. In these cases, it is often necessary to carry a separate bag with the disposal device in which to transfer the feces. As can be appreciated, the transferring of the feces from the scoop to the bag is messy and unpleasant.

A final limitation of prior art pet feces disposal devices is that since they are typically formed of expensive materials such as metal and wood, they are expensive to manufacture. Due to their high cost, pet owners must repeatedly reuse and wash the devices rather than throw them away. This defeats disposability and complicates the collection Of pet feces.

Accordingly, there is a need for an improved pet feces disposal device that overcomes the limitations of the prior art. More particularly, there is a need for a pet feces disposal device that is lightweight, portable, easy to use, self-sealing, inexpensive to manufacture and disposable.

OBJECTS AND SUMMARY OF THE INVENTION

In view of the limitations of prior art feces collection devices, it is an object of the present invention to provide a pet feces disposal apparatus that is lightweight, portable and disposable.

It is also an object of the present invention to provide a pet feces disposal apparatus that includes structure for enclosing and sealing the feces after it is collected.

It is another object of the present invention to provide a pet feces disposal apparatus that is formed of inexpensive materials.

In view of these objects and other objects that become evident from the following description of a preferred embodiment of the invention, a pet feces disposal apparatus that is lightweight, portable, self-sealing, disposable, inexpensive to manufacture and easy to use is provided. The preferred pet feces disposal apparatus broadly includes a foldable scoop for scooping and collecting pet feces and a bag for enclosing and sealing the scoop and the feces collected therein after use.

In more detail, the scoop is preferably formed of paperboard material and includes a plurality of walls and at least one fold line hingedly connecting the walls together. The walls are foldable along the fold line so that the scoop can be selectively folded to a collapsed state for storage or unfolded to a full size state for use in scooping and collecting pet feces.

The bag is preferably attached to the scoop for use in enclosing and sealing the feces and the scoop after collection. The bag is reversible so that the pet owner can initially place his or her hand in the bag to facilitate sanitary handling of the scoop while scooping the feces. After collection, the pet owner can reverse or turn the bag inside out to enclose and seal the scoop and the feces collected therein for disposal. The bag is preferably formed of thin lightweight synthetic resin materials so that it can be folded with the scoop when the scoop is in the collapsed state.

By providing a pet feces disposal apparatus as described herein, numerous advantages are realized. For example, by providing a scoop that is both foldable and formed of lightweight materials, the apparatus can be easily collapsed for storage and transport and then later unfolded for use. When in the collapsed state, the pet feces disposal apparatus can be conveniently carried in a pet owner's purse or pocket until ready for use.

Additionally, by providing a disposal bag attached to the scoop, a pet owner can first place his or her hand in the bag to collect the feces and then reverse the bag to seal the scoop and the feces after collection. This provides for sanitary collection and disposal of the pet feces and eliminates the odors and mess associated with conventional disposal devices.

Finally, by providing a pet feces disposal apparatus that is formed of inexpensive materials, the apparatus can be manufactured economically, thereby encouraging pet owners to buy and use the apparatus for cleaning up after their pets. Moreover, since the apparatus is disposable, messy clean-up of conventional collection devices is eliminated.

BRIEF DESCRIPTION OF THE DRAWING FIGURES

A preferred embodiment of the present invention is described in detail below with reference to the attached drawing figures, wherein.

DETAILED DESCRIPTION OF THE PREFERRED EMBODIMENTS

Figures 1, 2, 3, 4:
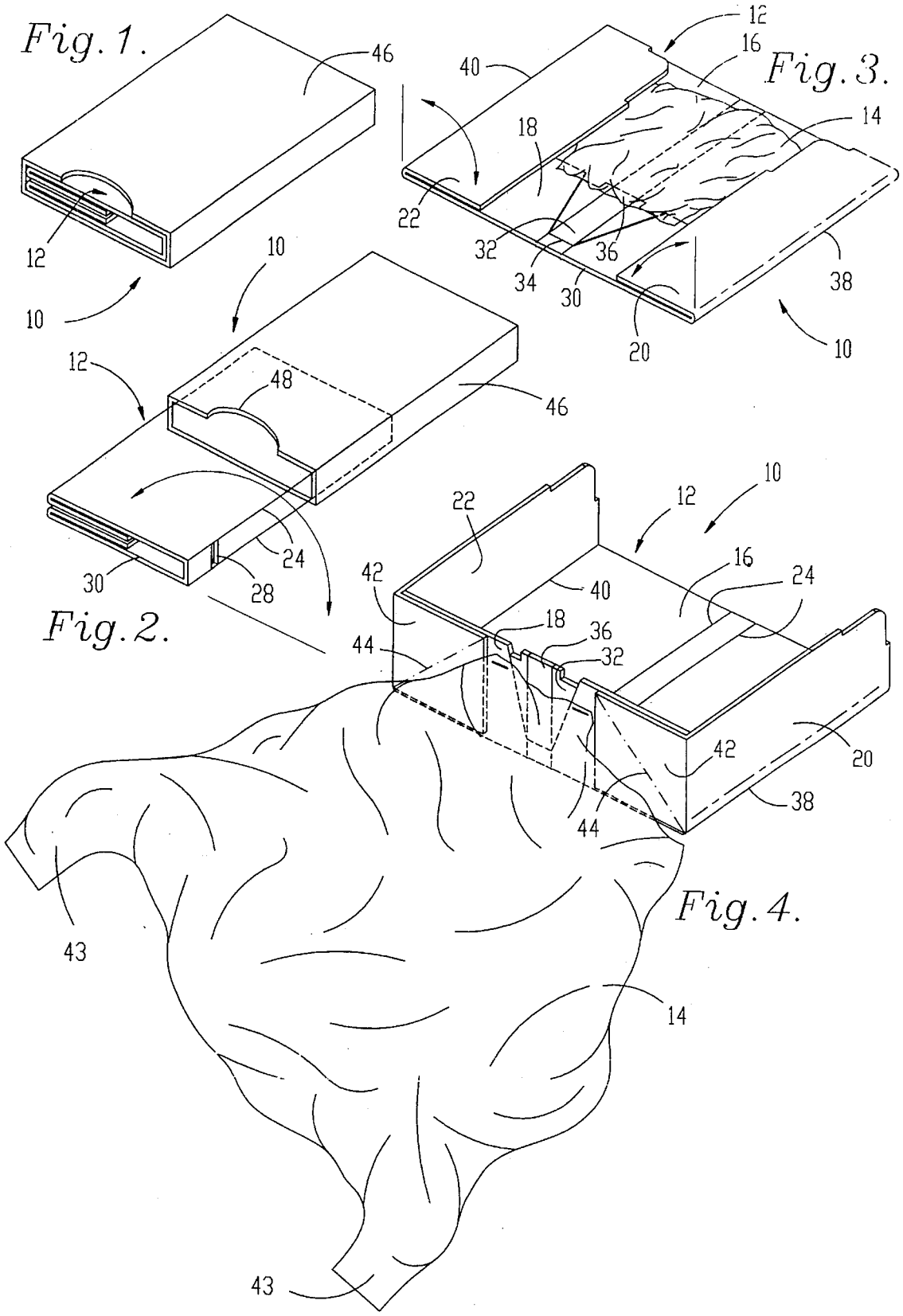
FIG. 1 is a perspective view of a pet feces disposal apparatus constructed in accordance with the preferred embodiments of the invention depicting the apparatus in its fully folded state.
FIG. 2 is a perspective view depicting the apparatus in a partially unfolded state.
FIG. 3 is a perspective view depicting the apparatus in a more fully unfolded state.
FIG. 4 is a perspective view depicting the apparatus in its fully unfolded state.

Referring to the drawing figures, a pet feces disposal apparatus 10 constructed in accordance with a preferred embodiment of the present invention is illustrated. As best illustrated in FIG. 4, the pet feces disposal apparatus 10 broadly includes a scoop 12 for scooping and collecting pet feces and a bag 14 secured to one end of the scoop 12 for enclosing, sealing and disposing the collected feces.

In more detail, the preferred scoop 12 includes a bottom wall 16, a back wall 18, a right side wall 20, a left side wall 22, and at least one fold line hingedly connecting the walls together. The walls 16, 18, 20, and 22 are preferably integrally formed of paperboard material, and the fold lines are preferably formed by scoring, folding, or stamping the paperboard material at specific locations to hingedly connect the walls 16–22 together. As described in more detail below, the walls 16–22 are foldable along the fold lines so that the scoop 12 can be selectively folded to a collapsed state for storage or unfolded to a full size state for use in scooping and collecting pet feces.

Returning to FIG. 4, the bottom wall 16 is provided for holding feces that is collected in the scoop 12 and is preferably approximately 5–6 inches wide and 4–5 inches deep. The bottom wall 16 includes a pair of parallel fold lines 24 near its mid-section that extend transverse to its front edge. As best illustrated in FIG. 2, the bottom wall 16 also includes a small slot 28 formed between the fold lines 24 near its rear edge for receiving a corresponding back wall breakaway tab 32 as described in more detail below.

The back wall 18 extends upwardly from the rear edge of the bottom wall 16 and is preferably approximately 5–6 inches wide and 1–2 inches tall. As best illustrated in FIG. 3, the back wall 18 is hingedly connected to the bottom wall 16 by a fold line 30 formed at the intersection of the walls 16 and 18.

The back wall 18 also includes an integral breakaway tab 32 near its mid-section that is hingedly connected to the remainder of the back wall 18 by a fold line 34. The sides of the tab 32 are separated from the back wall 18 so that the tab 32 can be pivoted about the fold line 34. The tab 32 includes a locking key portion 36 near its uppermost edge for engaging the slot 28 formed in the bottom wall 16 as described in more detail below.

The right and left side walls 20 and 22 extend upwardly from the right and left side edges of the bottom wall 16, respectively, and are generally parallel to each other but transverse to the back wall 18. Each side wall 20 and 22 is preferably approximately 4–5 inches deep and 1–2 inches tall. The side walls 20 and 22 are hingedly connected to the bottom wall 16 by fold lines 38 and 40, respectively, formed at the right and left side edges of the bottom wall 16.

As best illustrated in FIG. 4, the right and left side walls 20 and 22 each include an end flap 42 that folds over and covers a portion of the back wall 18. The flaps 42 are attached to the back wall 18 by conventional fasteners such as staples or adhesives. The flaps 42 each include a diagonally-extending fold line 44 for facilitating the folding and unfolding of the back wall 18 of the scoop 12.

The bag 14 is provided for covering the pet owner's hand during collection of pet feces in the scoop and for enclosing and sealing the collected feces and scoop for disposal. The bag is sized slightly larger than the scoop so that it can receive the scoop and collected feces after use.

Referring to FIG. 4, the closed end of the bag 14 is preferably attached to the scoop back wall 18 by conventional fasteners such as staples or adhesives. The open end of the bag includes a pair of integral handles 43 for use in carrying or tieing the bag 14.

The bag 14 is preferably formed of thin gauge, flexible synthetic resin material so that it can be folded with the scoop 12 when the scoop 12 is in the collapsed state. The bag 14 is also reversible so that the pet owner can initially place his or hand in the bag 14 while scooping the feces and then subsequently turn the bag 14 inside out to enclose and seal the scoop 12 and the feces therein.

As best illustrated in FIGS. 1 and 2, the pet feces disposal apparatus 10 may also include an outer sleeve 46 for storing the folded scoop 12 and bag 14 when not in use. The outer sleeve 46 is hollow and has open ends for receiving and discharging the folded scoop 12 and bag 14. One end of the outer sleeve 46 includes semicircle shaped cut out portions 48 for facilitating the gripping of the folded scoop 12 when removing it from the outer sleeve 46. The outer sleeve 46 is preferably formed of the same paperboard material as the scoop 12 and may include indicia on its outer surface in the form of instructions and/or advertising.

Use Of The Apparatus

In use, the pet feces disposal apparatus 10 described above can be selectively folded to a collapsed state for easy storage and transport or unfolded to an expanded state for use in collecting and disposing pet feces. Referring to FIG. 1, the scoop 12 and bag 14 are initially folded and received within the outer sleeve. When in this folded state, the entire pet feces disposal apparatus 10 is only approximately 4–5 inches long, 2–3 inches wide, and ¼–½ inches thick. This compact size allows the pet feces disposal apparatus 10 to be easily carried in the pet owner's pocket or purse until ready to be used.

When it is desired to use the pet feces disposal apparatus 10 to collect feces, the scoop 12 and bag 14 are removed from the outer sleeve 46 and unfolded. First, the bottom wall 16 is unfolded about the fold lines 24 as indicated by the arrows in FIG. 2. Then, as illustrated by the arrows in FIG. 3, the side walls 20 and 22, are unfolded from the bottom wall 16 about the fold lines 38 and 40. Next, the back wall 18 is unfolded about fold line 30 and the bag 14 is unfolded from the bottom wall 16 of the scoop 12 as illustrated in FIG. 4.

Figure 5:
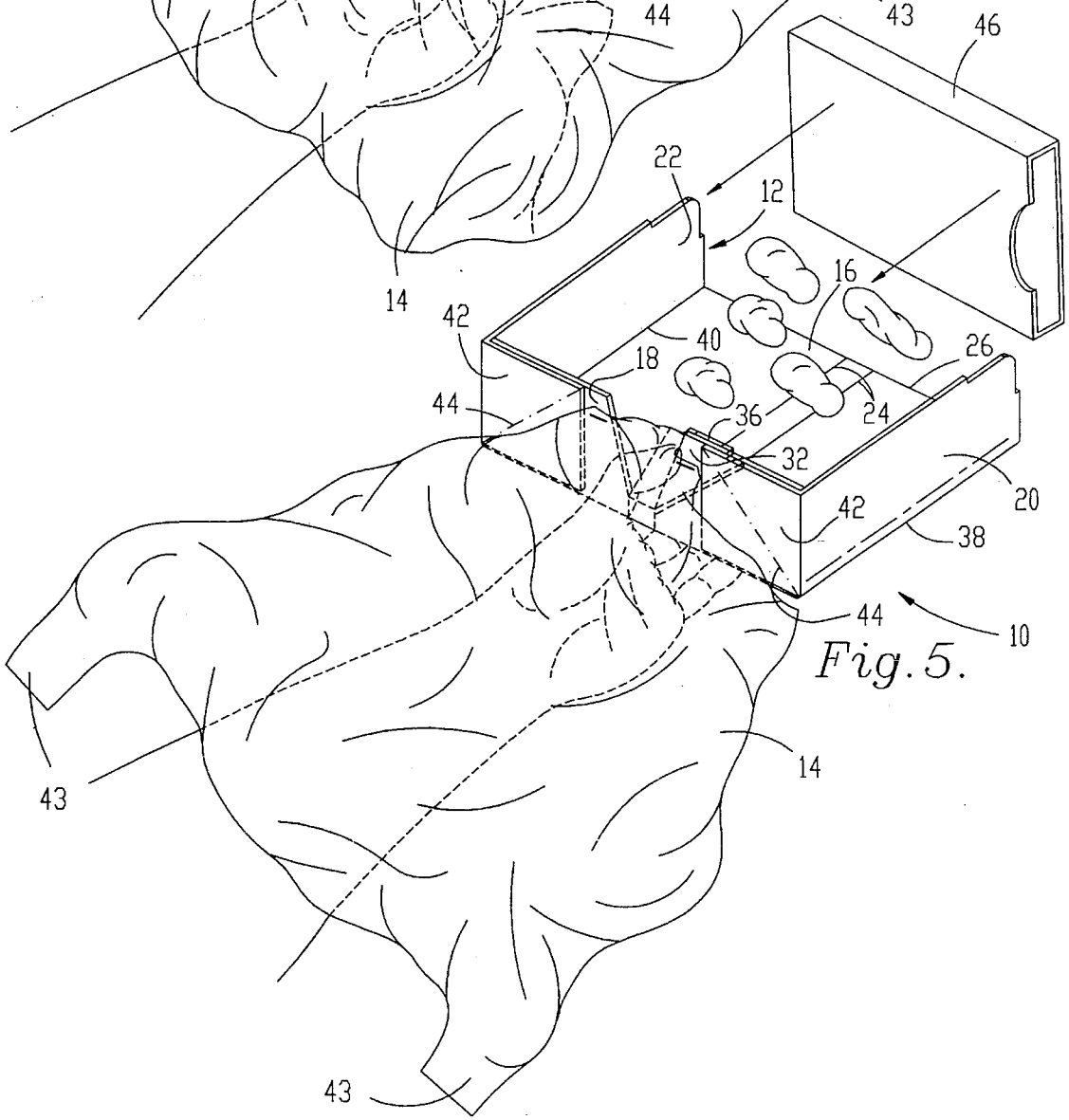
FIG. 5 is a perspective view depicting the apparatus in use for scooping pet feces.
Figure 6:
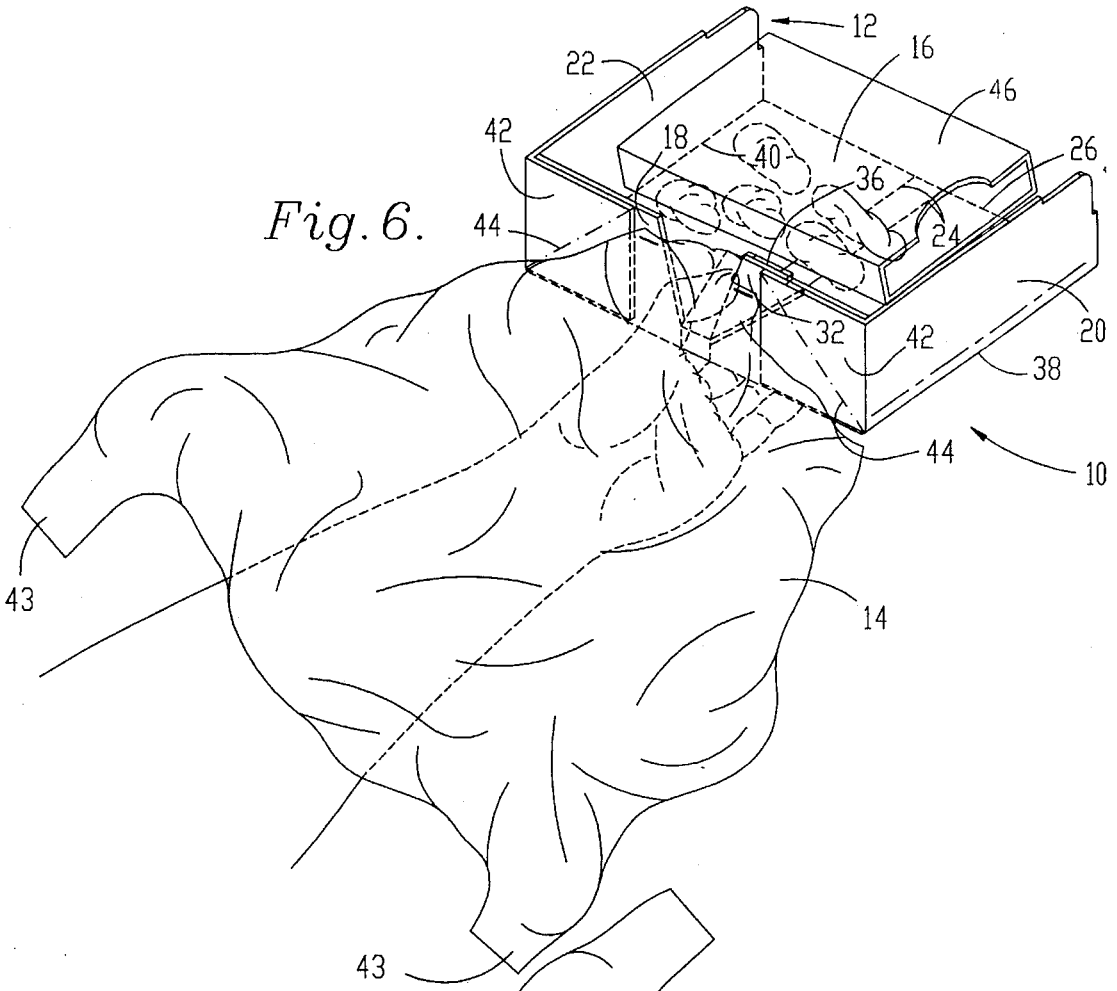
FIG. 6 is a perspective view depicting the apparatus after the collection of pet feces.

FIGS. 5 and 6 illustrate the collection of feces in the unfolded scoop 12 and bag 14. First, the pet owner places one of his or her hands in the bag 14 and pushes the breakaway tab 32 on the back wall 18 inward towards the bottom wall 16. The locking key 36 is then inserted into the slot 28 on the bottom wall 16 for locking the tab 32 alongside the bottom wall 16. This increases the rigidity of the assembled scoop 12 and provides a thumb hold for the pet owner when scooping with the apparatus 10.

To collect feces in the scoop 12, the pet owner either pushes the scoop 12 under the feces or uses the outer sleeve 46 to push the feces into the scoop 12 as illustrated in FIG. 5. Once all of the feces is collected, the outer sleeve 46 can be placed in the scoop for disposal with the feces as illustrated in FIG. 7.

Figure 7:
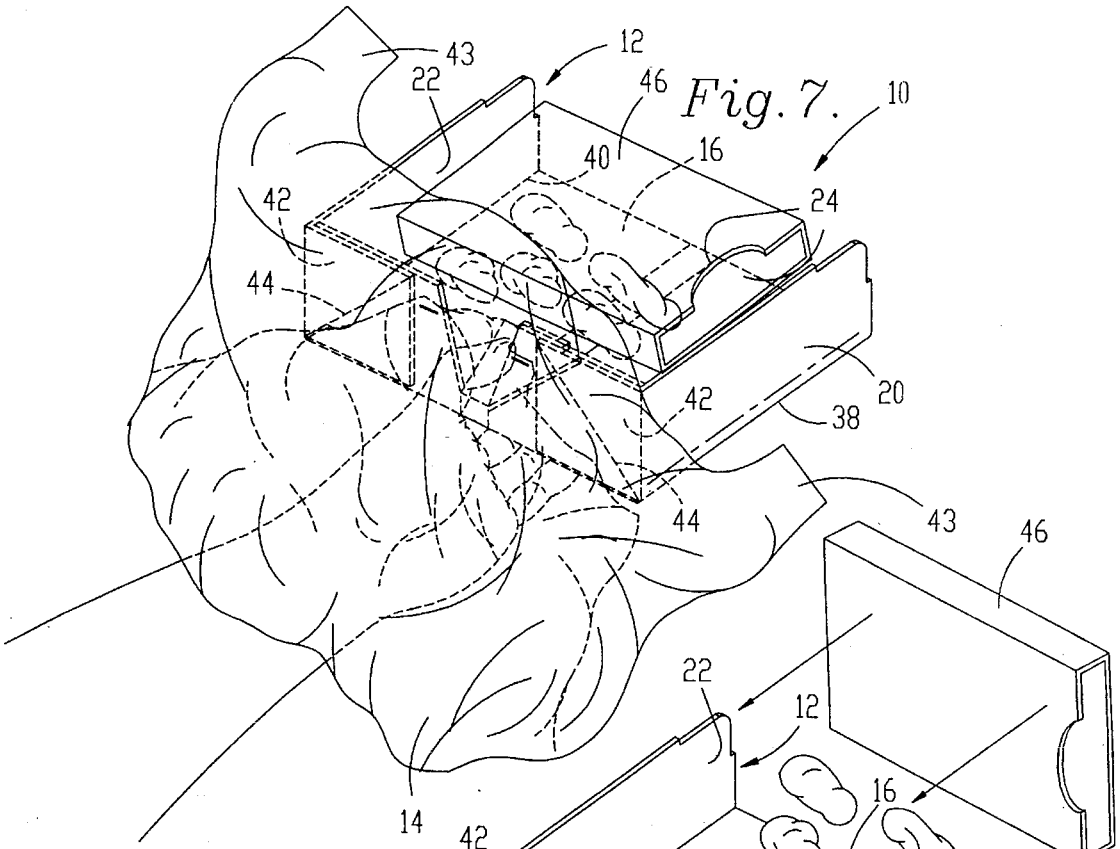
FIG. 7 is a perspective view depicting the apparatus as the reversible bag is partially pulled over the scoop.
Figure 8:
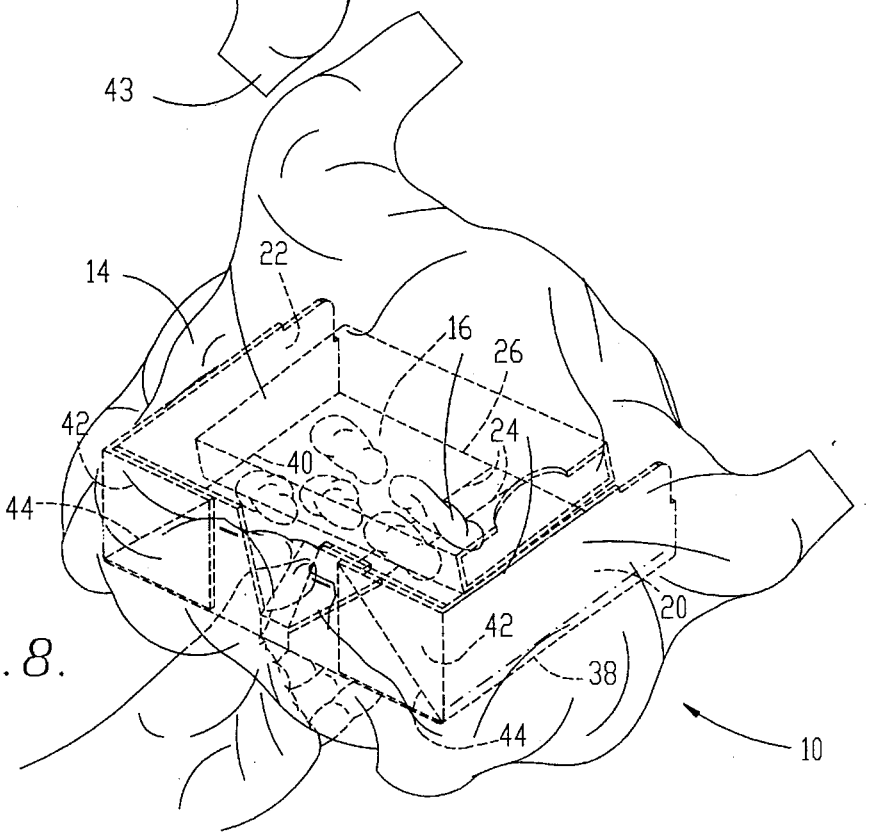
FIG. 8 is a perspective view depicting the apparatus as the reversible bag is fully pulled over the scoop and feces contained therein for enclosing and sealing the feces.

FIGS. 7 and 8 illustrate the sealing of the feces in the scoop 12 after collection. First, the pet owner pulls the bag 14 over his or her hand until it is reversed or turned inside out. This encloses the scoop 12 and the collected feces in the bag 14. Then, the pet owner either carries the bag 14 by its handles or ties and seals the bag 14 for disposal. This seals the collected feces in the bag 14, thus eliminating the mess and odors associated with conventional methods of collecting and disposing pet feces.

Although the invention has been described with reference to the preferred embodiment illustrated in the attached drawing figures, it is noted that equivalents may be employed and substitutions made herein without departing from the scope of the invention as recited in the claims. For example, although the scoop is preferably formed of paperboard material, it can be formed of other lightweight, foldable material such as flexible synthetic resin materials. Additionally, the scoop can be formed in a variety of shapes and sizes. Further, although the bag is preferably formed of thin flexible synthetic resin material, it can be formed of other suitable materials such as thin paper material that can be folded to lie flat within the scoop when in the collapsed or unfolded position.

Having thus described the preferred embodiment of the invention, what is claimed as new and desired to be protected by Letters Patent includes the following:

1. A portable pet feces disposal apparatus comprising:

a scoop for scooping and collecting pet feces, said scoop including at least one fold line and being foldable along said fold line so that said scoop can be selectively folded to a collapsed state for storage or unfolded to a full size state for use in scooping and collecting pet feces;

a bag secured to one end of said scoop for enclosing said scoop and the feces collected therein for disposal; and and outer sleeve for receiving and storing said scoop and bag when in said collapsed state.

2. A portable pet feces disposal apparatus comprising:

a scoop for scooping and collecting pet feces, said scoop including a bottom wall, a back wall, a pair of opposed side walls, and at least one fold line connecting said walls together, said walls being foldable along said fold line so that said scoop can be selectively folded to a collapsed state for storage or unfolded to a full size state for use in scooping and collecting pet feces;

a bag secured to one end of said scoop for enclosing said scoop and the feces collected therein after use, said bag being positioned so that it can be folded with said scoop when said scoop is in said collapsed state; and an outer sleeve for receiving and storing said scoop and bag when in said collapsed state.

3. The apparatus as set forth in claim 2, said scoop being formed of paperboard material.

4. The apparatus as set forth in claim 3, said scoop presenting a length, width and thickness of less than five, three and ½ inches, respectively, when in said collapsed state.

5. A portable pet feces disposal apparatus comprising:

a scoop for scooping and collecting pet feces, said scoop including a bottom wall having a front edge and a rear edge and including a pair of adjacent bottom wall sections hingedly connected by a bottom wall fold line, and a back wall extending upwardly from said bottom wall rear edge and hingedly connected to said bottom wall rear edge by a back wall fold line; and a bag secured to said back wall for enclosing said scoop and the feces collected therein;

said back wall being foldable along said back wall fold line to overlie said bottom wall, said bag being collapsible to overlie said folded back wall and said bottom wall, and said bottom wall sections being foldable along said bottom wall fold line so that said scoop can be selectively folded to a collapsed state and said bag can be enclosed within said folded scoop for storage.

* * * * *